US007677330B2

(12) United States Patent
Hammond

(10) Patent No.: US 7,677,330 B2
(45) Date of Patent: Mar. 16, 2010

(54) APPARATUS FOR IN SITU TESTING OF A SOIL SAMPLE

(76) Inventor: Peter Hammond, Freestone Farmhouse, Main Street, Bugthorpe, York (GB) YO41 1QG ( * ) Notice: Subject to any disclaimer, the term of this patent is extended or adjusted under 35 U.S.C. 154(b) by 159 days.

(21) Appl. No.: 11/674,892

(22) Filed: Feb. 14, 2007

(65) Prior Publication Data

US 2008/0190664 A1 Aug. 14, 2008

(51) Int. Cl.
*E21B 7/26* (2006.01)
*E21B 49/08* (2006.01)

(52) U.S. Cl. ..... 175/20; 175/59

(58) Field of Classification Search ..... 175/59, 175/20, 226, 249, 17; 73/864.44
See application file for complete search history.

(56) References Cited

U.S. PATENT DOCUMENTS

| | | | | |
|---|---|---|---|---|
| 4,809,790 | A * | 3/1989 | Manchak, Jr. | 175/17 |
| 5,101,917 | A * | 4/1992 | Abdul et al. | 175/253 |
| 5,561,066 | A | 10/1996 | Sinha | |
| 5,884,714 | A * | 3/1999 | Heller et al. | 175/20 |
| 6,086,767 | A * | 7/2000 | Walters et al. | 210/634 |
| 6,347,675 | B1 * | 2/2002 | Kolle | 175/69 |
| 6,695,075 | B2 * | 2/2004 | Beeker | 175/58 |
| 6,938,461 | B1 | 9/2005 | Johnson | |
| 2004/0120772 | A1 * | 6/2004 | Vinegar et al. | 405/128.85 |
| 2005/0173156 | A1 * | 8/2005 | Miller et al. | 175/62 |

FOREIGN PATENT DOCUMENTS

| | | | |
|---|---|---|---|
| EP | 0403699 | A1 | 12/1990 |
| WO | WO03035987 | A2 | 5/2003 |

OTHER PUBLICATIONS

Crabtree, Robert H.; Mingos, D. Michael P. Comprehensive Organometallic Chemistry III, vols. 1-13. (pp. 839-840). Elsevier. Online version available at: http://knovel.com/web/portal/browse/display?_EXT_KNOVEL_DISPLAY_bookid=1768&VerticalID=0.*

* cited by examiner

*Primary Examiner*—David J Bagnell
*Assistant Examiner*—James G Sayre
(74) *Attorney, Agent, or Firm*—Adams Intellectual Property Law

(57) ABSTRACT

An apparatus for in situ testing of a soil sample includes an elongate body having a hollow core and an open end, an upper barrier or means for forming an upper barrier within soil across the hollow core, and means for forming a lower barrier within soil across the hollow core such that a sample zone is defined with the hollow core between the upper and lower barriers. A fluid supply means delivers a fluid to the sample zone; and a fluid exit means removes the fluid from the sample zone.

11 Claims, 3 Drawing Sheets

APPARATUS FOR IN SITU TESTING OF A SOIL SAMPLE

TECHNICAL FIELD AND BACKGROUND OF THE INVENTION

This invention relates to an apparatus and related method for testing soil for the presence of contaminants.

Industrial activity has lead to the deposition of many different chemical species in soil, some of which may be toxic to the local environment. Before large areas of soil are distributed, for example on a construction site, it is important to analyse the soil in order to ascertain the pollutants present. This is to avoid unnecessary or prolonged exposure to dangerous chemicals and/or to know how decontamination may be carried out.

Several methods of testing soil for pollutants are known. However, even within a relatively small area, pollutant levels may vary widely at different locations or different soils depths. Consequently, soil samples from a number of locations must be analysed, if a good assessment is to be made.

Known methods involve removal of a sample of soil which is then analysed at a laboratory. Analysis may be by a standard chemical method, in which the chemical pollutants are extracted and their structure and concentrations determined. Alternatively or additionally, the soil may be assessed by examining the bacteria present in a sample. A favoured method is to carry out a biological assay in which beetles, worms and the like are dissected and the level of chemicals absorbed in their tissues determined.

Such methods are involved and time-consuming, and in some cases may lead to inaccurate results. Collection of a soil sample disturbs the environment around which the sample is located. This in itself may lead to the sample being contaminated. For example, it may be difficult to obtain a sample from, for example, a meter below the surface without removing the soil above and thus changing the environment of the sample.

Once the sample is removed from its environment, the composition may change. Volatile components may evaporate: air sensitive moieties present may be oxidised or decomposition may occur during the interval between collection and analysis of a sample.

If a particular sample is found to be high in pollutants, it is often desirable to collect further samples from the surrounding area and at different depths so as to fully assess the extent of the pollution. This can often necessitate several trips to a site, which is expensive and inefficient.

SUMMARY OF THE INVENTION

It is an object of the present invention to try to overcome at least some of the disadvantages of current methods of soil testing.

According to a first aspect of the invention, there is provided an apparatus for in situ testing of a soil sample, the apparatus comprising:

(a) an elongate body having a hollow core and an open end;

(b) an upper barrier or means for forming, in use, an upper barrier, within soil, across said hollow core;

(c) means for forming, in use, a lower barrier, within soil, across said hollow core such that a sample zone is defined with the hollow core between said upper and lower barriers;

(d) fluid supply means for delivery of a fluid to said sample zone; and (e) fluid exit means for removal of said fluid from said sample zone.

The elongate body is preferably cylindrical, and circular. The hollow core is also preferably cylindrical, and more preferably circular. The core may be defined by an inner cylinder which is coaxial with an outer cylinder such that a cavity is formed therebetween. This cavity may house various pipework and other parts as described in the embodiments below.

In a preferred embodiment, the two coaxial cylinders which form the elongate body and define the hollow core are preferably formed from a tough, strong, corrosion resistant metal, for example stainless steel.

In preferred embodiments, the means for forming a lower barrier across the hollow core of the elongate body of the apparatus comprises means for freezing the soil across the core. Suitably, such means comprises the supply of a cryogenic material to a particular region within the core of the metal body such that in use, a plug or seal of frozen soil will form across the core at that region. The temperature of the frozen soil is less than −10° C., preferably less than −30° C., more preferably less than −50° C. and most preferably less than −65° C.

BRIEF DESCRIPTION OF THE DRAWINGS

The invention may be best understood by reference to the following detailed description taken in conjunction with the accompanying drawings in which.

DETAILED DESCRIPTION OF PREFERRED EMBODIMENTS

Figure 1:
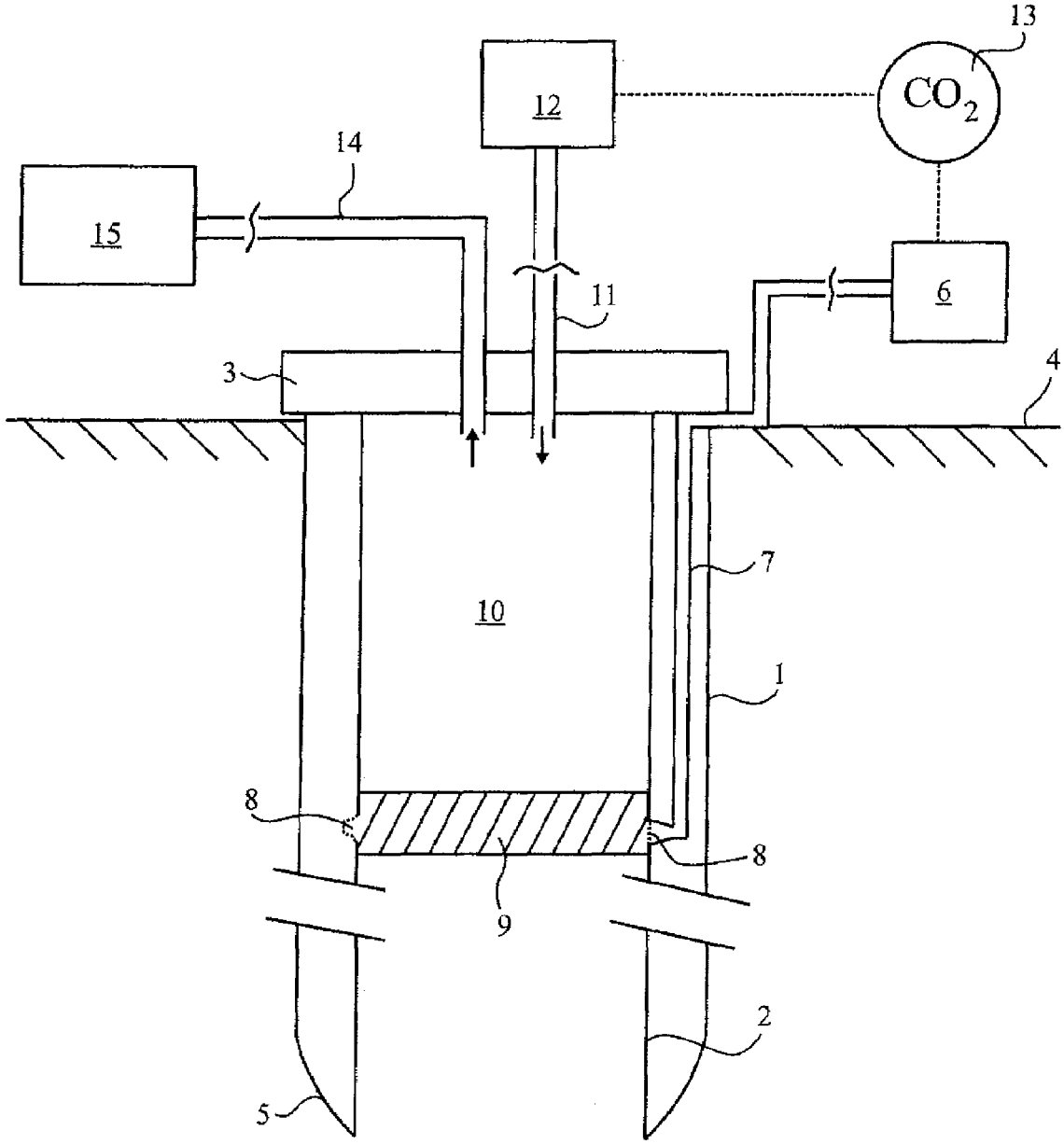
FIG. 1 is a diagrammatic representation of a first embodiment of the invention which can be used to test a sample of soil at the surface.

The cryogenic material is preferably supplied to the region within the core through at least one aperture in the inner cylinder which defines the core. Preferably, it is supplied through two or more apertures which are approximately equally spaced around a circumference located on the inner surface of the inner cylinder. Cryogenic material may be supplied to these aperture(s) by one or more pipes located within the cavity between the inner and outer cylinders and connected to an external source of cryogenic material. Any suitable cryogenic material may be used, for example liquid nitrogen or liquid helium. An especially preferred cryogenic material is liquid carbon dioxide.

The barrier across the hollow core may simply comprise a closed upper end of the elongate body. In such embodiments, the apparatus would be limited to the testing of soil located at and just beneath the surface.

In other embodiments in which soil of varying depths may be tested, the means for forming an upper seal across the hollow core may comprise means for freezing the soil across the core at a second region. This region is higher than the first region but may be formed by exactly the same method, and preferred aspects for doing so are the same for forming the upper seal as were described with references to the lower seal.

Thus, in certain embodiments, the sample zone of soil to be tested is located in a volume defined by the walls of the elongate body, closed at one end, the closed end forming an upper seal, and a frozen plug of soil forming a lower seal.

In preferred embodiments, the sample zone is held within a volume defined by the walls of the elongate body, a frozen soil plug forming a lower barrier across the core and frozen soil plug forming an upper barrier across the core.

The fluid supply means are located between the means for forming the upper seal and the means for forming the lower seal such that fluid may be delivered to the soil contained within the sample zone. The inner surface of the elongate body which defines the hollow core may suitably be provided with one or more inlet aperture(s) which may be connected via a type of pipe or tube system to an external fluid source. This may comprise the fluid supply means.

The fluid exit means are also located between the means for forming the upper seal and the means for forming the lower seal. The fluid exit means may comprise one or more outlet apertures located on the inner surface of the core. These apertures may be connected to a pipe or tube which leads to an external collection source. The fluid supply means and fluid exit means are preferably opposite to each other.

Thus, when the soil testing apparatus is in use, fluid enters the sample zone from the fluid source by passing along pipework and through inlet apertures. This fluid then leaves the sample zone through the outlet apertures, along pipework to a collection point. The pipework which connects to the inlet and outlet apertures may be located in the cavity located between the body and core (preferably in the form of coaxial cylinders) which form the elongate body and define the inner hollow core.

The fluid delivered to the collection point will have dissolved therein chemical pollutants found in the soil. This may be saved in sample vials and tested at a later date. Preferably, however, fluid delivered to the collection point is tested on site thus enabling any necessary further readings to be taken straight away and minimising any degradation of the sample which would occur over time.

Any standard analytical technique may be used to analyse the sample, for example gas or liquid chromatography, or chromatography in combination with mass spectrometry.

The fluid chosen to effect extraction of pollutants from the soil sample for testing may comprise any suitable solvent.

The fluid is typically added to the sample at an elevated temperature, preferably at a temperature greater than 30° C., more preferably greater than 50° C. and most preferably greater than 70° C. Preferably, the temperature of the fluid added to the soil sample is less than 150° C., preferably less than 120° C., more preferably less than 100° C.

The fluid added to the sample may be under increased pressure. Preferably pressures of at least $2\times10^5$ Pa [2 bar] are employed, more preferably pressures of at least $5\times10^5$ Pa [5 bar], and most preferably pressures of at least $1\times10^6$ Pa [10 bar]. Preferably the pressure of the fluid supplied to the sample does not exceed $5\times10^7$ Pa [500 bar], and more preferably does not exceed $3\times10^7$ Pa [300 bar].

In certain embodiments the fluid added to the sample might not be under increased pressure, but it is usually necessary to pressurise the fluid in order to deliver it to the sample zone.

Suitable extraction fluids for use in the present invention include: hydrocarbons, for example propane or hexane; alcohols, for example ethanol or isopropanol; aqueous salt solutions, for example of potassium chloride; halogenated solvents, for example dichloromethane; ketones, for example acetone; and solutions of phosphates and/or borates. Preferred fluids include water and especially, carbon dioxide. Preferably, the conditions are such that the fluids are supplied in a supercritical state.

By supercritical fluid is meant a dense gas that is maintained above its critical temperature (the temperature above which it cannot be liquefied by pressure), as defined in Hawley's Condensed Chemical Dictionary, $12^{th}$ Edition, p 1107.

In a preferred embodiment in which the extraction fluid comprises carbon dioxide, the fluid is typically added to the sample at a pressure of at least $5\times10^6$ Pa, preferably at least $1\times10^7$ Pa, more preferably at least $1.5\times10^7$ Pa, more preferably at least $2\times10^7$ Pa and most preferably at least $2.4\times10^7$ Pa. The pressure of carbon dioxide when added to the sample is preferably less than $5\times10^7$ Pa, more preferably less than $4\times10^7$ Pa, preferably less than $3\times10^7$ Pa and most preferably less than $2.6\times10^7$ Pa.

The cryogenic fluid and the extraction fluid may comprise the same material. Preferably both fluids comprise carbon dioxide.

Suitably the supply of cryogenic material is such that during the extraction process, the upper and lower barriers of frozen soil remain intact throughout the process.

The lower open end of the elongate body preferably tapers towards its lower end. Preferably, it forms a sharp lower edge. When the elongate body comprises two coaxial cylinders with a cavity between, the cylinders are preferably Joined at the lower end so that no soil may enter the cavity as the apparatus is inserted in the ground. In such embodiments, the inner cylinder is preferably straight sided down to its end and the outer cylinder preferably tapers in to meet it. This shape ensures that when this lower end of the apparatus is pushed into the soil, it is the soil on the outside of the apparatus which is most disrupted leaving a less disturbed sample within the hollow core.

The means for forming a lower seal, the means for forming an upper seal, the fluid supply means and the fluid exit means may all be located at fixed positions within the apparatus. Thus, in order to analyse samples of soil taken from various depths, the apparatus should be pushed into the soil at different depths, and it is the distance at which the apparatus is pushed into the soil which determines the position at which the soil sample is analysed.

In an alternative embodiment, the means for forming a lower barrier, the means for forming an upper barrier, the fluid supply means and the fluid exit means may be all fixed relative to each other. However, their position may change relative to the elongate body. In such an embodiment, the body is preferably comprised of two coaxial cylinders. The inner cylinder comprises a plurality of apertures spaced throughout its length. Housed within the cavity between the two cylinders is a system of pipework.

At least one pipe supplies a cryogenic material to a first region to form the lower seal. At least one pipe supplies a cryogenic material to a second region, at a position higher than the first region to form the upper seal across the core. The cryogenic material may be supplied by a single pipe having at least two openings at different locations or there may be two separate pipes. These may be spaced at a fixed distance or may move relative to each other.

Between the two openings which supply cryogenic material, there is at least one pipe which supplies fluid to the sample zone. This may be fixed or may move relative to the two pipe openings which supply cryogenic material. Also in this region (between the openings which supply cryogenic material), there are receiving means which accept fluid containing dissolved pollutants and transfer it to the surface to be analysed.

In this embodiment, the metal body is fully pushed into the soil up to its maximum length. The size of the apertures on the inner cylinder is chosen so that soil cannot exit but so that fluid and cryogenic material can enter the inner core. Preferably, the apertures have areas of less than 1 $mm^2$, preferably less than 0.5 $mm^2$. Preferably, the apertures are roughly circular, of 0.35 mm in diameter.

The various pipes which transfer fluid and cryogenic material may then be positioned at different locations along the length of the body to allow soil to be tested at different depths.

The apparatus may be such that samples may only be tested at certain discrete intervals. For example, apertures may be located at specific, regularly spaced positions. Preferably, however, the selected soil sample may be tested at any depth within the apparatus.

In an especially preferred embodiment, the various pipes which supply the cryogenic material and fluids are fixed to a mask. This is suitably a cylindrical surface (or partial surface), which hold each pipe opening in fixed relative positions. Such a mask can then be moved in a vertical direction within the cavity between the body and the core.

Preferably, the hollow core of apparatus of the present invention has an area of at least 10 $cm^2$, preferably at least 15 $cm^2$, more preferably at least 18 $cm^2$. Preferably the cross sectional area is less than 80 $cm^2$, more preferably less than 50 $cm^2$ and most preferably less than 30 $cm^2$.

The length of the body is preferably at least 0.5 m, more preferably at least 0.8 m, most preferably at least 1 m. The length of the apparatus is preferably less than 12 m, more preferably less than 8 m, more preferably less than 5 m and most preferably less than 3 m. The height of the soil sample tested is typically at least 5 cm, preferably at least 10 cm, more preferably at least 15 cm. The height of the sample test may be up to 50 cm, preferably up to 35 cm, more preferably up to 25 cm.

The volume of the sample of soil tested is preferably at least 50 $cm^3$, more preferably at least 100 $cm^3$, preferably at least 200 $cm^3$ and most preferably at least 300 $cm^3$. The volume of soil test is preferably less than 2000 $cm^3$, preferably less than 1500 $cm^3$, more preferably less than 1000 $cm^3$ and most preferably less than 500 $cm^3$.

According to a second aspect of the invention, there is provided a method of testing a sample of soil, the method comprising the steps of:

(a) driving into the ground, at the area to be tested an apparatus according to the first aspect;

(b) forming a lower seal across the core, and, if necessary forming an upper seal to isolate the sample zone between said seals;

(c) supplying a pressurised fluid to said sample zone;

(d) collecting fluid which has passed through said sample zone; and (e) analysing the collected fluid.

Step (a) may be carried out by any conventional drilling technique, for example using Caterpillar 3306 DITA with dual hydraulic rotary drive. Such methods are well known to those skilled in the art and need no further explanation here.

Preferred features of the second aspect of the invention are as defined in relation to the first aspect.

The apparatus shown in FIG. 1 comprises an outer metal body 1 which is cylindrical, and an inner cylinder 2 which defines the hollow core of the apparatus. When the apparatus is in use as in FIG. 1, the core is filled with soil. In this case, the apparatus comprises a cap 3, which forms the upper seal across the core. The apparatus has been driven into the ground and the cap 3 sits on the surface 4. The process of driving the apparatus into the ground is facilitated by the tapered shape 5 of the lower open end of the elongate metal body.

In use, the apparatus is driven into the ground and once in position, liquid carbon dioxide is delivered from source 6 along pipe 7 through apertures 8 to a horizontal region of soil which forms a frozen lower barrier 9, defining a sample zone 10.

The pipe 7 may have several openings at the same horizontal level spaced around a circumference on the surface of cylinder 2, each opening being positioned in communication with a corresponding aperture 8 in the cylinder. Thus, liquid $CO_2$ is delivered into the soil from several positions and a barrier of frozen soil 9 having a temperature of approximately −70° C. soon forms.

Once the seal has been formed, carbon dioxide is supplied to sample zone 10 such that it is in a supercritical state within the zone. In this case supply is via pipe 11 which enters through the lid. The source of supercritical carbon dioxide 12 and the source of liquid carbon dioxide 6 are linked to a common supply 13.

The supercritical carbon dioxide is at a pressure of $2.5\times10^7$ Pa and a temperature of 80° C.

The supply of liquid carbon dioxide is such that the frozen barriers of soil remains intact when the supercritical fluid is supplied therebetween.

Contaminants in the soil become dissolved in the supercritical carbon dioxide and due to an increase in pressure fluid comprising dissolved pollutants is expelled and exits the sample zone through pipe 14. This fluid is collected and analysed using a gas chromatography mass spectrometer 15.

Figure 2:
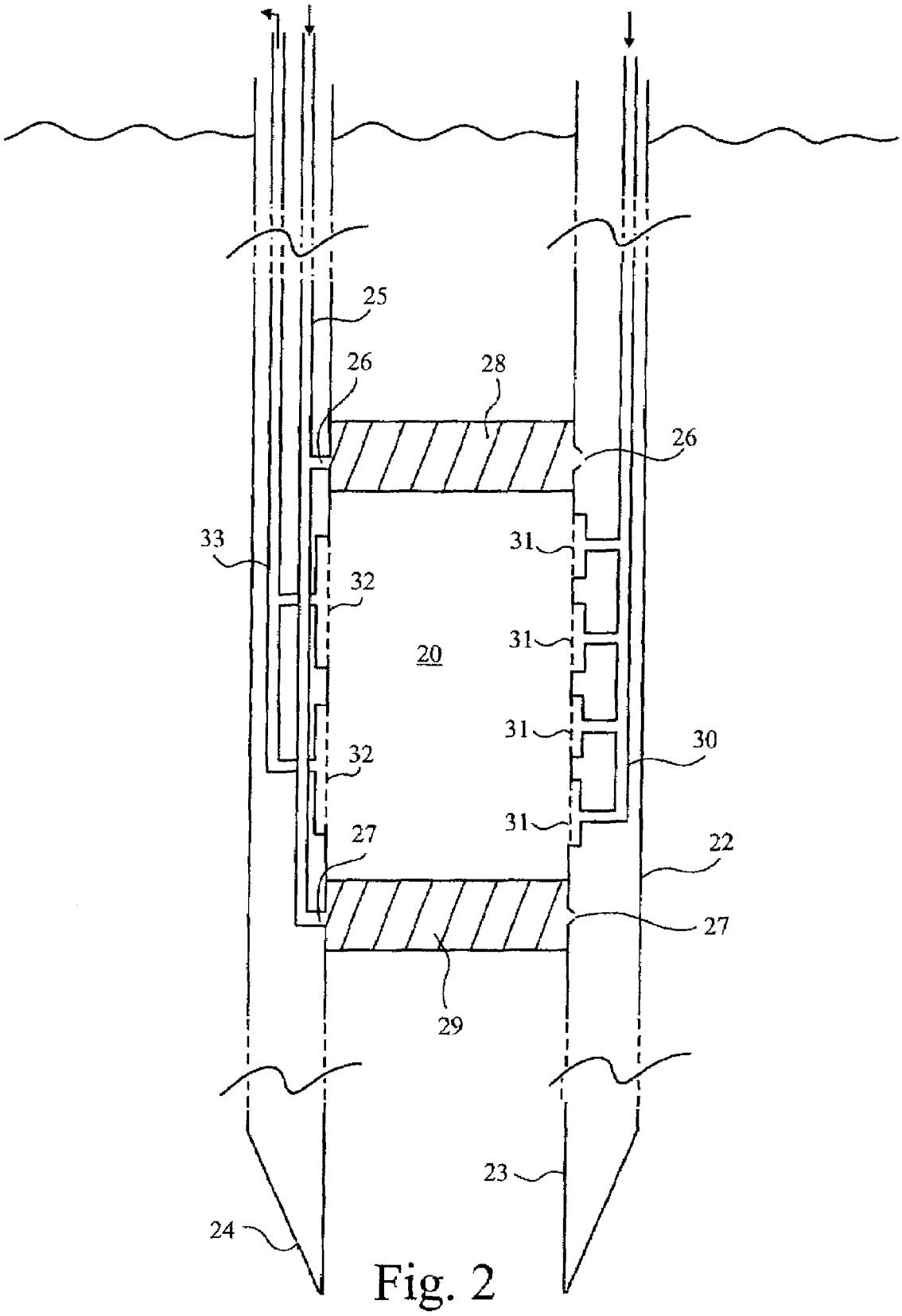
FIG. 2 is a diagrammatic representation of a second embodiment in which the sample zone may be formed at a fixed position within the body of the apparatus.

In the second embodiment shown in FIG. 2, the sample zone 20 is formed below the surface 21 of the soil. The apparatus again comprises an outer metal cylinder 22, and an inner cylinder 23, having an outwardly tapered lower end 24.

In use, this apparatus is driven into the ground using conventional drilling techniques to a depth sufficient to ensure that sample zone 20 will be formed at a desired distance below the surface. Once in position, liquid carbon dioxide is supplied through pipe 25 to outlet apertures 26 and 27. As defined in relation to the first embodiment shown in FIG. 1, a plurality of apertures are provided around a common circumference such that liquid carbon dioxide may enter a horizontal region from several directions. Thus upper seal 28 and lower seal 29 are formed, from frozen soil at about −70° C.

Once the seals have formed, supercritical carbon dioxide (250 bar, 80° C.) is delivered via pipe 30 to sample zone 20. In this case, the openings from pipe 30 permit fluid delivery through a large number of apertures 31 which are well spaced around the internal surface area of inner cylinder 23. Also spaced around the surface of inner cylinder 23 are exit apertures 32. These are connected to exit pipe 33 which delivers the fluid containing dissolved contaminants to a collection point outside the apparatus. This is then analysed by traditional chemical techniques. If a sample is to be taken at a different depth, the whole apparatus is driven further into the soil and the process is repeated.

Figure 3:
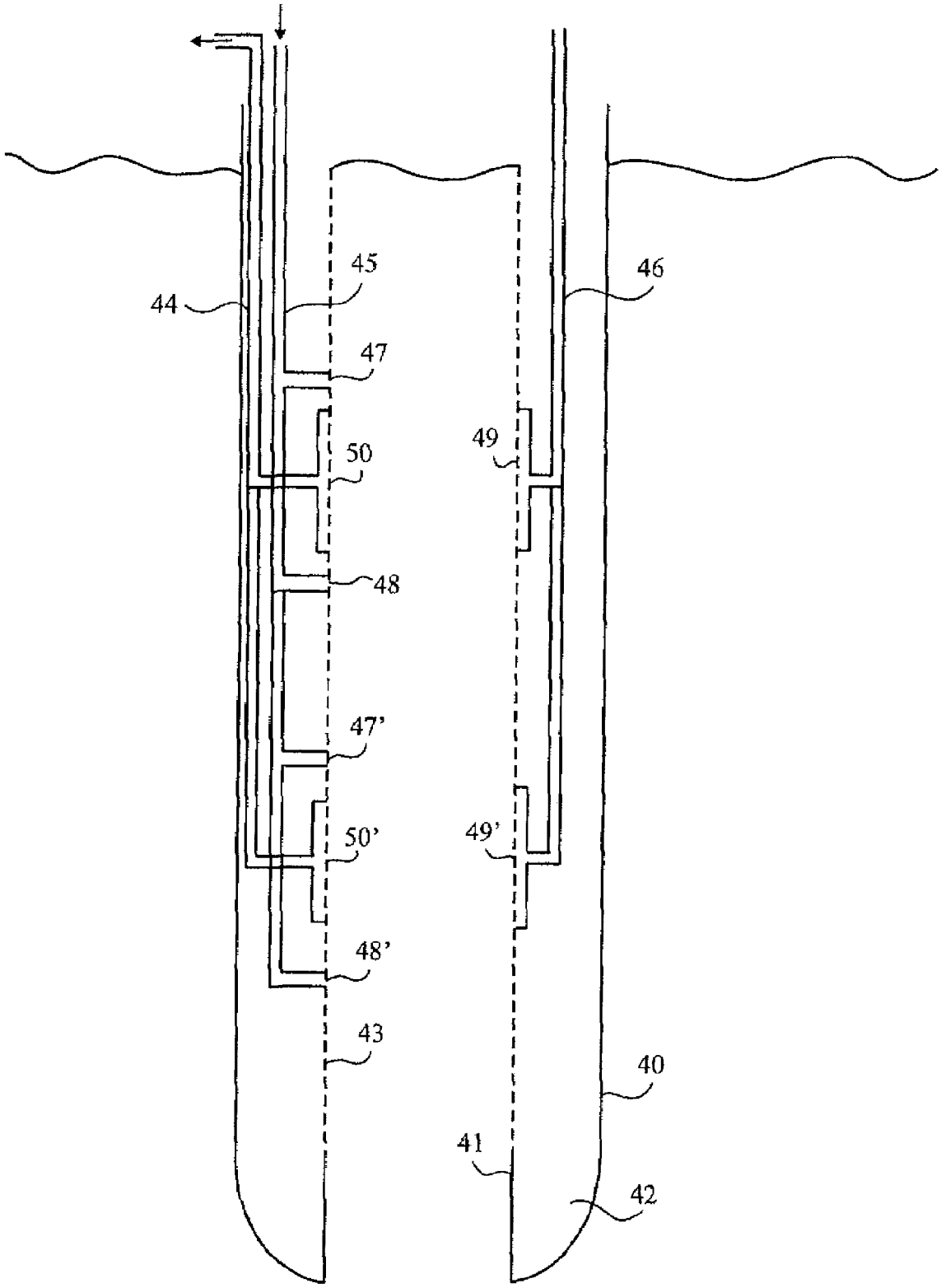
FIG. 3 is a diagrammatic representation of a third embodiment in which the sample zone may be formed at several locations within the body of the apparatus.

The embodiment shown in FIG. 3 also comprises two coaxial metal cylinders 40 and 41 having a cavity 42 therebetween. In this apparatus, inner cylinder 41 comprises a plurality of apertures 42 throughout most of its length.

This apparatus has a length of 3.5 meters and is driven all the way into the ground. The three pipe systems 44, 45 and 46 are all attached to a cylindrical mask, which is not shown. This mask may move in a vertical direction within cavity 42, carrying the pipe with it to various positions within the cavity.

Pipe 45 supplies liquid carbon dioxide and has two outlet regions 47 and 48. (There may in fact be a plurality of outlets circumferentially spaced at the same horizontal level). This permits the formation of an upper seal at 47 and a lower seal at 48. Supercritical $CO_2$ can then be supplied to the sample zone formed therebetween via pipe 46 through apertures in outlet region 49. This fluid is then discharged through apertures located ahead of exit region 50 leading to pipe 44 which carries the contaminated fluid from the apparatus, and it is then analysed.

Once this has been completed, the mask is lowered such that pipes 44, 45 and 46 then sit at a new position and the process repeated: upper and lower seals will form at positions 47' and 48'; supercritical carbon dioxide with enter through region 49', and exit through region 50'.

I claim:

1. An apparatus for in situ testing of a soil sample, the apparatus comprising:

(a) an elongate body having a hollow core and an open end;

(b) an upper barrier or means for forming, in use, an upper barrier, within soil, across said hollow core;

(c) means for forming, in use, a lower barrier, within soil, across said hollow core such that a sample zone is defined with the hollow core between said upper and lower barriers;

(d) fluid supply means for delivery of a fluid to said sample zone; and (e) fluid exit means for removal of said fluid from said sample zone;

in which the elongate body and hollow core comprise two coaxial metal cylinders.

2. An apparatus according to claim 1, in which the means for forming an upper barrier, the means for forming a lower barrier, the fluid supply means and the fluid exit means is movable relative to the elongate body to occupy various positions along its length.

3. An apparatus according to claim 1, in which the fluid supply means is adapted to supply carbon dioxide.

4. An apparatus according to claim 3, in which the fluid supply means is adapted to supply carbon dioxide in a supercritical state.

5. An apparatus according to claim 4, in which the fluid supply means is adapted to supply carbon dioxide at a temperature of approximately 80° C. and a pressure of approximately $2.5\times1^{7}$ Pa.

6. An apparatus for in situ testing of a soil sample, the apparatus comprising:

(a) an elongate body having a hollow core and an open end;

(b) an upper barrier or means for forming, in use, an upper barrier, within soil, across said hollow core;

(c) means for forming, in use, a lower barrier, within soil, across said hollow core such that a sample zone is defined with the hollow core between said upper and lower barriers;

(d) fluid supply means for delivery of a fluid to said sample zone; and (e) fluid exit means for removal of said fluid from said sample zone;

in which the means for forming, in use, a lower barrier across the hollow core comprises supplying a cryogenic material across the core to form a plug of frozen soil.

7. An apparatus according to claim 6, in which the cryogenic material is liquid carbon dioxide.

8. An apparatus according to claim 6 in which the means for forming an upper barrier, the means for forming a lower barrier, the fluid supply means and the fluid exit means is movable relative to the elongate body to occupy various positions along its length.

9. An apparatus for in situ testing of a soil sample, the apparatus comprising:

(a) an elongate body having a hollow core and an open end;

(b) an upper barrier or means for forming, in use, an upper barrier, within soil, across said hollow core;

(c) means for forming, in use, a lower barrier, within soil, across said hollow core such that a sample zone is defined with the hollow core between said upper and lower barriers;

(d) fluid supply means for delivery of a fluid to said sample zone; and (e) fluid exit means for removal of said fluid from said sample zone;

in which the means for forming, in use, an upper barrier across the hollow core comprises supplying a cryogenic material across the core to form a plug of frozen soil.

10. An apparatus according to claim 9, in which the cryogenic material is liquid carbon dioxide.

11. An apparatus according to claim 9 in which the means for forming an upper barrier, the means for forming a lower barrier, the fluid supply means and the fluid exit means is movable relative to the elongate body to occupy various positions along its length.

* * * * *